US005814943A

United States Patent [19]

Adamovski

[11] Patent Number: 5,814,943

[45] Date of Patent: Sep. 29, 1998

[54] DIRECT CURRENT REGULATION PLASMA DEVICE

[75] Inventor: Victor Isaevich Adamovski, Petah Tikvah, Israel

[73] Assignee: New Devices Engineering A.K.O. Ltd., Petah Tikvah, Israel

[21] Appl. No.: 852,485

[22] Filed: May 7, 1997

[51] Int. Cl.[6] ..... H01J 1/46

[52] U.S. Cl. ..... 315/111.41; 313/161; 313/162

[58] Field of Search ..... 313/231.31, 161, 313/162; 315/111.41

[56] References Cited

U.S. PATENT DOCUMENTS

| | | | |
|---|---|---|---|
| 1,059,763 | 4/1913 | Reisz | 313/161 X |
| 2,551,798 | 5/1951 | Hansell | 313/162 X |
| 3,501,376 | 3/1970 | Dow et al. | 313/161 X |
| 4,596,945 | 6/1986 | Schumacher et al. | 315/111.41 X |
| 5,132,597 | 7/1992 | Goebel et al. | 315/111.41 X |

*Primary Examiner*—Robert J. Pascal
*Assistant Examiner*—Justin P. Bettendorf
*Attorney, Agent, or Firm*—Mark M. Friedman

[57] ABSTRACT

A gas discharge tube for regulating the flow of high power direct current, and a method for its use. The tube is provided with pairs of secondary electrodes flanking the current path from the anode to the cathode, and with solenoids for generating a magnetic field perpendicular to the current path from the anode to the cathode and also perpendicular to a transverse direction defined by the secondary electrode pairs. This magnetic field diverts part or all of the primary current, flowing from the cathode to the anode, to the secondary electrodes.

11 Claims, 8 Drawing Sheets

DIRECT CURRENT REGULATION PLASMA DEVICE

FIELD AND BACKGROUND OF THE INVENTION

The present invention relates to the control of high power direct electrical current and, more particularly, to a gas discharge tube that uses crossed electrical and magnetic fields to divide or interrupt direct electrical current.

It long has been known that in many applications, DC is more efficient than AC. For example, DC power transmission losses are 6%–7% lower than AC power transmission losses; in transmission over wires of the same cross section, direct current can be 66% higher than AC current; and the speed of a DC motor can be varied continuously by varying the current strength. Nevertheless, AC has been preferred to DC in most engineering and household applications, because high power DC switches and current control devices are significantly more complex than their AC counterparts.

Low current and low voltage DC switches are known. Gas discharge tubes have been used for the pulsed interruption of limited currents for short periods of time, time periods that are too short for the total interruption of high inductance DC circuits carrying high current and voltage. These devices are also incapable of regulating the voltage or current in the circuit, or of providing reduced voltage or current to a secondary circuit in the manner of, for example, an AC transformer.

The state of the art in this field is described, for example, in Lutz and Hofman, "The Camitnon, a high power crossed field switch tube for AVDC interruption", *IEEE Trans. of Plasma Science*, Vol. PS-2pp. 11–24, March 1974; U.S. Pat. No. 4,034,261; Harvey, Lutz and Callaghan, "Current interruption at powers up to 1 GW with crossed field tubes", *IEEE Trans. of Plasma Science*, Vol. PS-6 No. 3, pp. 248–255, September 1978; and V. P. Andronova et al., "Powerful gas-discharge current interrupter with magnetic control", *Pribory I Tekhnika Eksperimenta*, no. 3, 1983, pp. 235–236 (in Russian).

There is thus a widely recognized need for, and it would be highly advantageous to have, a device for switching and regulating high power direct current that is as simple and reliable as the corresponding AC devices.

SUMMARY OF THE INVENTION

According to the present invention there is provided a gas discharge tube including: (a) a rigid envelope; (b) a cathode, deployed within the envelope; (c) an anode, deployed within the envelope, the cathode and the anode defining between them a current path; (d) at least one pair of secondary electrodes, deployed within the envelope so that the current path runs between a first electrode of the at least one pair and a second electrode of the at least one pair, the first electrode of the at least one pair and the second electrode of the at least one pair defining between them a transverse direction; and (e) a mechanism for creating a magnetic field substantially perpendicular to both the current path and the transverse direction, so that a plasma, within the envelope, wherethrough an electrical current travels from the anode to the cathode, is caused to separate into a positive region adjacent to the first electrode of the at least one pair and a negative region adjacent to the second electrode of the at least one pair.

According to the present invention there is provided a method for regulating direct electrical current, including the steps of: (a) providing a gas discharge tube including: (i) a cathode, (ii) an anode, and (iii) at least two secondary electrodes; (b) causing the current to flow through a plasma in the gas discharge tube from the anode to the cathode; and (c) separating charge in the plasma so that a region of positive charge is formed adjacent to one of the secondary electrodes and a region of negative charge is formed adjacent to another of the secondary electrodes.

The device of the present invention is a gas discharge tube in which the charge carriers are the electrons and ions of an overall neutral plasma within the tube, and in which the current path from the anode to the cathode is flanked by one or more pairs of secondary electrodes. An external magnetic field is used to separate the charge carriers, forming a region of positive charge near one member of each pair of secondary electrodes and a region of negative charge near the other member of each pair of secondary electrodes. The resulting voltage difference between the members of each pair of secondary electrodes may be connected in series with an external load. Preferably, the external magnetic field is provided by solenoids external to the gas discharge tube and in series with the cathode. The extent to which the current is diverted is controlled by the position of the solenoids relative to each other and relative to the gas discharge tube, thus changing the strength of the magnetic field.

Note that, although the predominant charge carriers in the device of the present invention are electrons, that travel from the cathode to the anode, the convention used herein is that a positive electrical current corresponds to a positive charge, and thus travels from the anode to the cathode.

In use, the device of the present invention is placed in series with a high power primary DC circuit to be controlled. If only part of the current is diverted to the secondary electrodes, the device of the present invention may be used as a source of direct current, characterized by a voltage and current lower than those of the primary circuit, in a secondary circuit that includes the secondary electrodes. By attaching the secondary electrodes to a suitable load and diverting all of the current to the secondary electrodes, the primary circuit can be interrupted completely.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a gas discharge tube which can be used to regulate high power direct current.

The principles and operation of high power direct current regulation according to the present invention may be better understood with reference to the drawings and the accompanying description.

Figure 1:
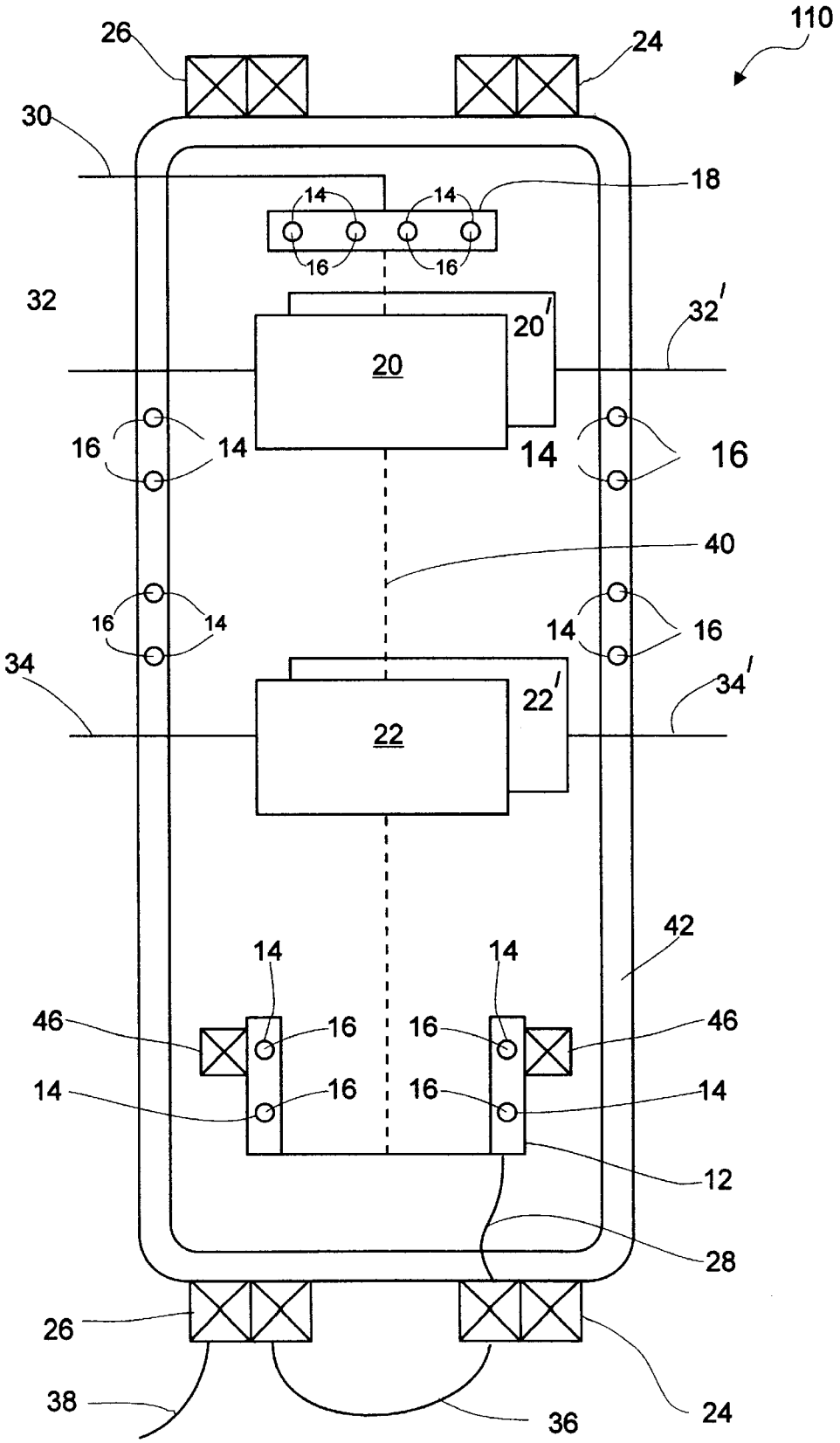
FIG. 1 is a schematic longitudinal cross section of a first preferred embodiment of a device of the present invention.

Referring now to the drawings, FIG. 1 is a schematic longitudinal cross section of a first preferred embodiment 10 of a device of the present invention. Within, and at opposite ends of, a sealed rigid envelope 42, are a ring-shaped cathode 12 and a planar anode 18. Cathode 12 and anode 18 define between them a current path 40. Flanking current path 40 are two pairs of parallel planar secondary electrodes, a first pair 20 and 20', and a second pair 22 and 22'. Electrodes 20 and 20' are positioned on opposite sides of current path 40, as are electrodes 22 and 22', so that current path 40 runs between electrodes 20 and 20', and between electrodes 22 and 22'.

The remainder of the interior volume of envelope 42 is filled with an inert gas, such as hydrogen, nitrogen, or a noble gas such as helium or argon, at a pressure of between about 0.001 mm Hg and about 0.6 mm Hg. Envelope 42 itself is made of a dielectric material, preferably glass or cermet.

Surrounding envelope 42 are two exterior solenoids 24 and 26. As better seen in FIG. 2, which is a schematic exterior view of device 10 from the same point of view as FIG. 1, solenoids 24 and 26 are slidably positioned on the exterior surface of envelope 42 so that electrical current flowing through solenoids 24 and 26 creates a magnetic field in the interior of envelope 42 that points horizontally and parallel to the plane of FIGS. 1 and 2. Cathode 12 is connected to solenoid 24 by a lead 28, and solenoid 24 is connected to solenoid 26 by a lead 36, so that solenoids 24 and 26 are in series with cathode 12. Anode 18, electrodes 20, 20', 22 and 22', and solenoid 26 are connected to external circuitry by leads 30, 32, 32', 34, 34' and 38, respectively. Encircling cathode 12, and connected in parallel with cathode 12, is an interior solenoid 46 whose purpose is described below. Solenoid 46 is in series with a thermal relay (not shown) whose purpose also is described below.

Cathode 12, anode 18 and envelope 42 are provided with cooling channels 14, within which circulates a cooling dielectric fluid 16 such as Freon. This circulation preferably is by natural convection with boiling, so that it is not necessary to pump fluid 16 through channels 14. For simplicity, only a small portion of cooling channels 14 of envelope 42 are shown in FIG. 1. An outlet conduit 48 conducts hot cooling fluid 16 to a heat exchanger (not shown) where fluid 16 is cooled and reintroduced to device 10 via an inlet conduit 50 as shown in FIG. 2.

Figure 2:
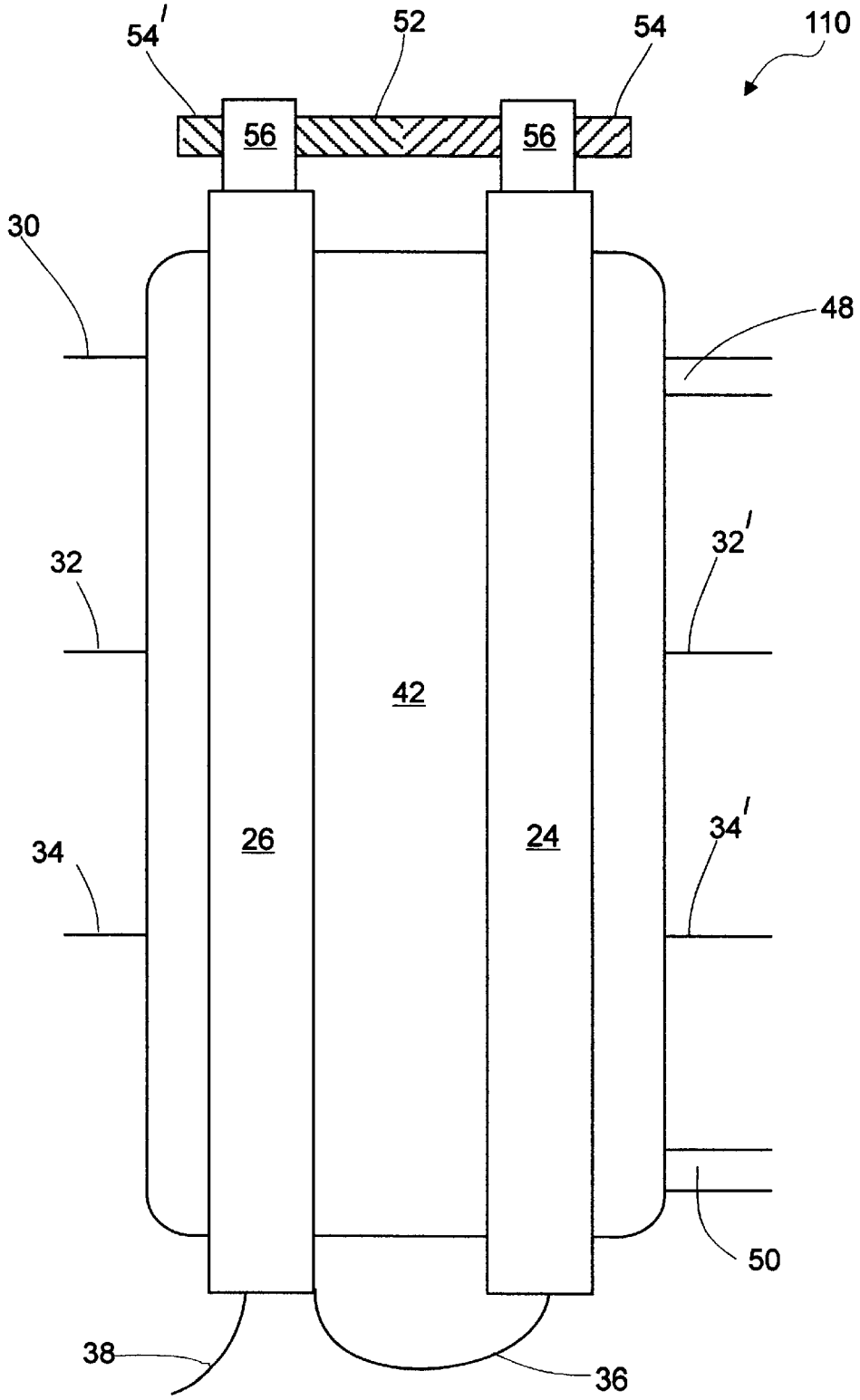
FIG. 2 is a schematic exterior view of the device of FIG. 1.

Also shown in FIG. 2 is a portion of a mechanism for sliding solenoids 24 and 26 horizontally relative to each other and to envelope 42. This mechanism includes a screw 52 having oppositely threaded portions 54 and 54', threaded through oppositely threaded nuts 56 and 56' that are rigidly attached to solenoids 24 and 26, respectively. This mechanism is illustrative only, and any equivalent mechanism may be used.

To use device 10 to regulate the current in a primary DC circuit, device 10 is incorporated in series with the primary circuit using leads 30 and 38. Either or both of lead pairs 32 and 32' or 34 and 34' are connected to secondary loads as described in more detail below. Upon the onset of power delivery by the primary circuit, an ignition unit (not shown) initiates a low pressure electric discharge (the so-called "glow discharge") at cathode 12 and anode 18, characterized by low current densities between about 10 A/cm$^2$ and about 1000 A/cm$^2$. Under the influence of solenoid 46, the glow discharge glides over the surface of cathode 12, uniformly heating the surface of cathode 12 to the temperature of thermionic emission (930° C.–950° C. if cathode 12 is made of copper; 3200° C.–3300° C. if cathode 12 is made of tungsten). When this temperature is reached, the thermal relay disconnects solenoid 46 and device 10 is in operational mode, with at least part of the current of the primary circuit flowing through solenoids 24 and 26 and from anode 18 to cathode 12 via the plasma within envelope 42.

The current flowing through solenoids 24 and 26 creates a transverse magnetic field B within envelope 42. Conduction through the plasma is characterized by two parameters, the electron-ion collision mean free time $\tau$ and the electron cyclotron frequency $\omega$32 eB/(mc), where e is the electron charge, m is the electron mass, and c is the speed of light. Typically, $1<\omega\tau<100$, so the electron current is 10 to 30 times higher than the ion current, and the current through device 10 is given by:

$$j = \sigma_0 E_{\parallel} + \frac{\sigma_0 E_{\perp}}{1+(\omega\tau)^2} + \frac{\sigma_0 \omega\tau[B \times E]}{[1+(\omega\tau)^2]|B|}$$

where $\sigma_0$ is the electric conductivity of the plasma in the absence of a magnetic field, $E_{\parallel}$ is the component of the electric field parallel to the magnetic field, and $E_{\perp}$ is the component of the electric field perpendicular to the magnetic field. Under the influence of the strong transverse magnetic field created by solenoids 24 and 26, the Hall effect adds a component to the velocities of the charge carriers (electrons and ions) of the plasma that is perpendicular to both the electric field and the magnetic field. As a result, the current flows at an angle $\alpha=\arctan(\omega\tau)$ to the direction of the electric field, rather than parallel to the electric field. The charge carriers are diverted to electrodes 20, 20', 22 and 22', setting up a potential difference between electrodes 20 and 20', and another potential difference between electrodes 22 and 22'. These potential differences can be used to drive secondary DC circuits connected to leads 32 and 32' or to leads 34 and 34'. The magnitudes of the currents diverted to the secondary circuits and of the potential differences imposed on the secondary circuits are determined by the strength of the magnetic field B, which is in turn determined by the distance between solenoids 24 and 26. Both B and the extent to which current is diverted to the secondary circuits are maximized when solenoids 24 and 26 are together and are minimized when solenoids 24 and 26 are at maximum separation.

Figure 3:
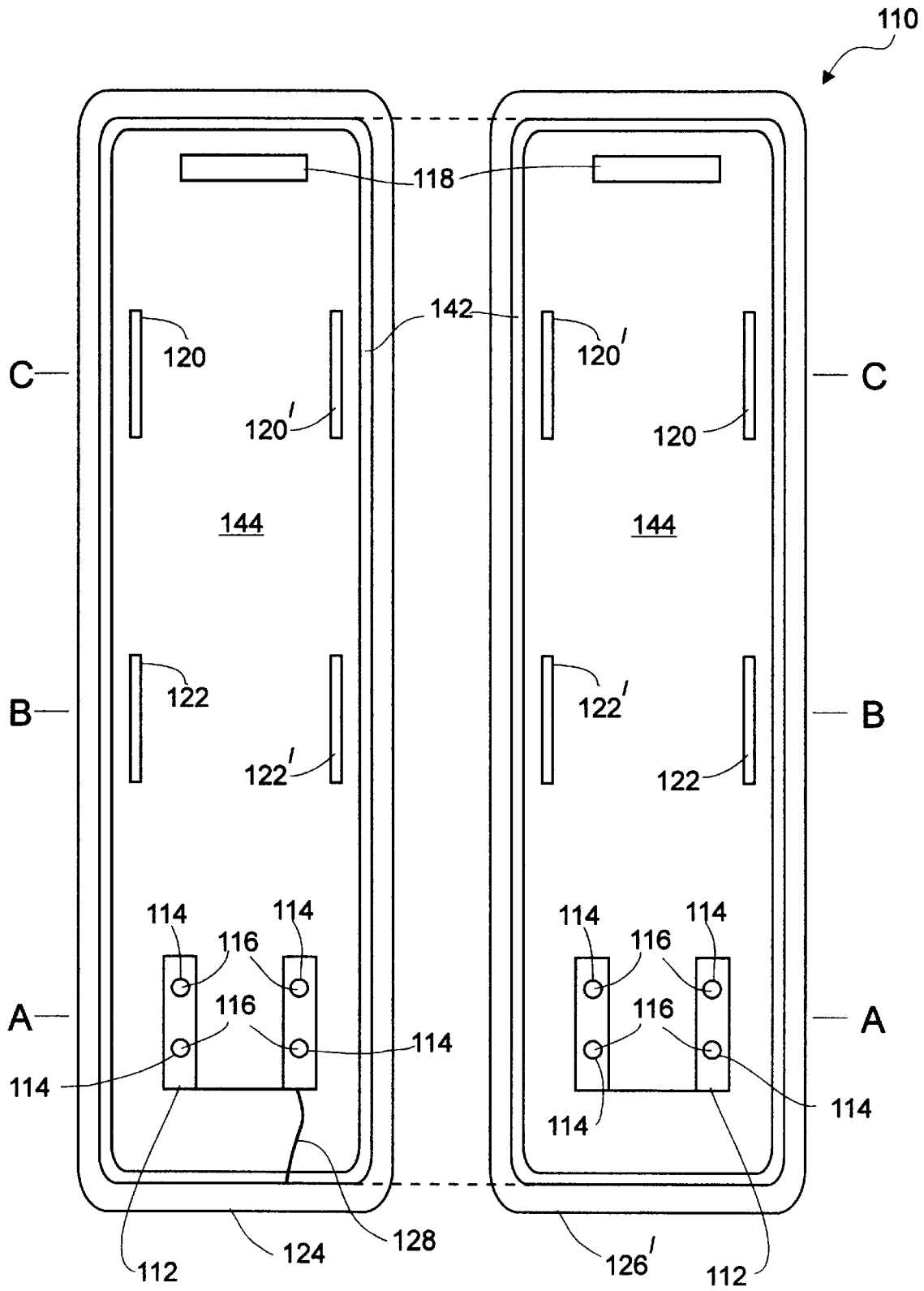
FIG. 3 is a schematic longitudinal cross section of a second preferred embodiment of a device of the present invention.
Figure 4A:
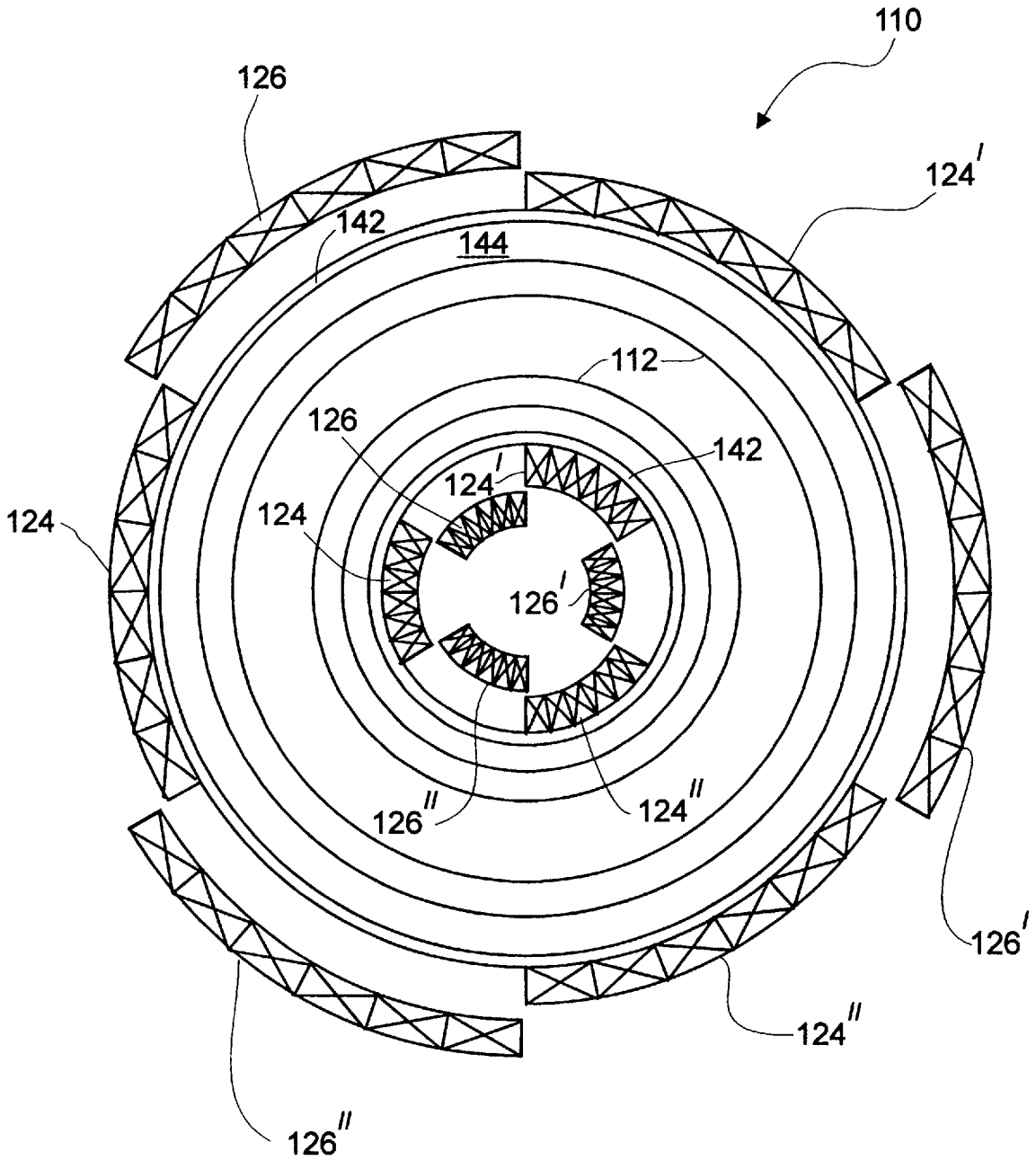
FIG. 4A is a schematic transverse cross section of the device of FIG. 3, along cut A—A.
Figure 4B:
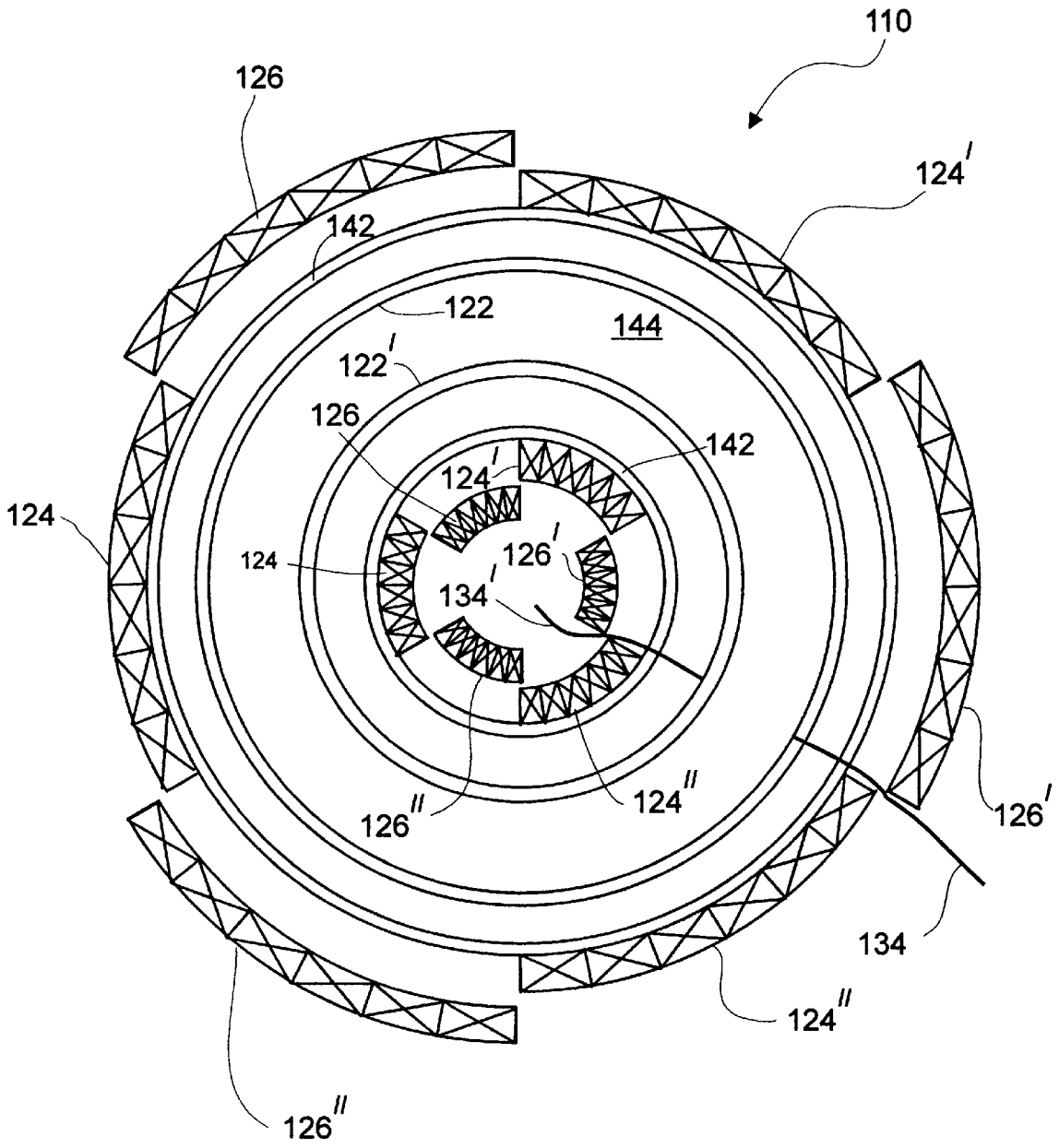
FIG. 4B is a schematic transverse cross section of the device of FIG. 3, along cut B—B.
Figure 4C:
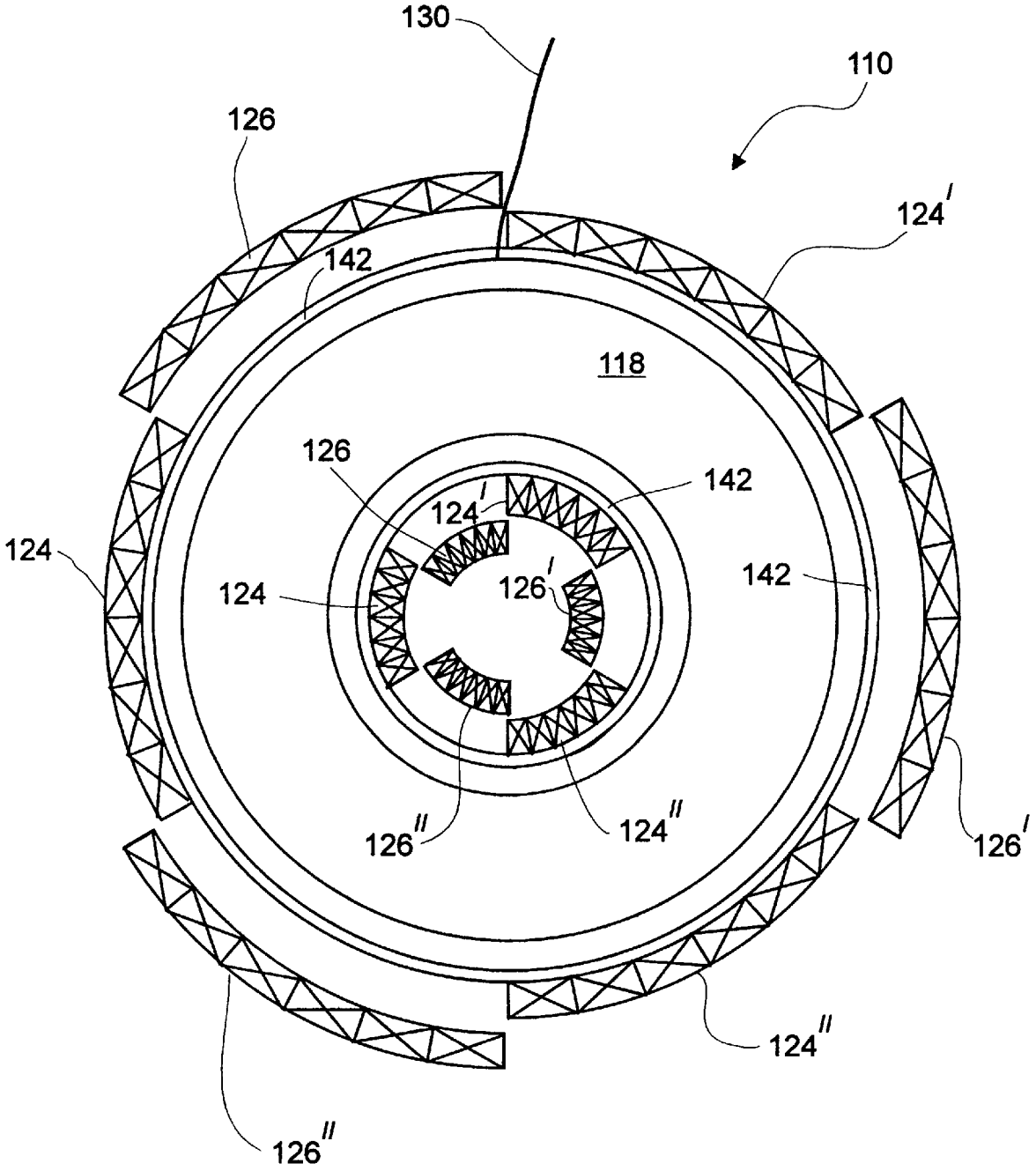
FIG. 4C is a schematic transverse cross section of the device of FIG. 3, along cut C—C.

FIGS. 3, 4A, 4B and 4C illustrate a second embodiment 110 of a device of the present invention. FIG. 3 is a schematic longitudinal cross section of device 110. FIGS. 4A, 4B and 4C are schematic transverse sections of device 110 along cuts A—A, B—B and C—C, respectively. In embodiment 110, envelope 142 is toroidal in shape, rather than cylindrical, but is otherwise identical to envelope 42 of device 10. At opposite ends of envelope 142 are a cathode 112, shaped as an elongated ring, and an O-shaped planar anode 118. Between cathode 112 and anode 118 are two pairs of concentric annular secondary electrodes, a first pair 120 and 120', and a second pair 122 and 122'. As in device 10, the current path from anode 118 to cathode 112 runs between electrodes 120 and 120', and between electrodes 122 and 122'. The remainder of the interior volume of envelope 142 is filled with an inert gas 144.

Surrounding envelope 142 are six exterior solenoids 124, 124', 124", 126, 126' and 126", each of which occupies about a 60° arc around the circumference of envelope 142. Solenoids 124, 124' and 124" are rigidly attached to envelope 142. Solenoids 126, 126' and 126" are rigidly connected to each other, and are slidably attached to solenoids 124, 124' and 124", radially beyond solenoids 124, 124' and 124" as shown, so that solenoids 126, 126' and 126" slide as a unit azimuthally around solenoids 124, 124' and 124". Electrical current flowing through solenoids 124, 124', 124", 126, 126' and 126" creates a magnetic field in the interior of envelope 142 that points azimuthally. Cathode 112 and solenoids 124, 124', 124", 126, 126' and 126" are all in series, with, for example, cathode 112 connected to solenoid 124 by a lead 128. Anode 118, electrodes 120, 120', 122 and 122', and solenoid 126" are connected to external circuitry by other leads, only three of which are shown for simplicity: lead 130 from anode 118, lead 134 from electrode 122, and lead 134' from electrode 122'. Encircling and in parallel with cathode 112 is an interior solenoid (not shown) that is analogous to solenoid 46 of device 10.

As in the case of device 10, cathode 112, anode 118 and envelope 142 of device 110 are provided with cooling channels within which circulates a dielectric cooling fluid 116. For simplicity, only cooling channels 114 of cathode 112 are shown.

Figure 5A:
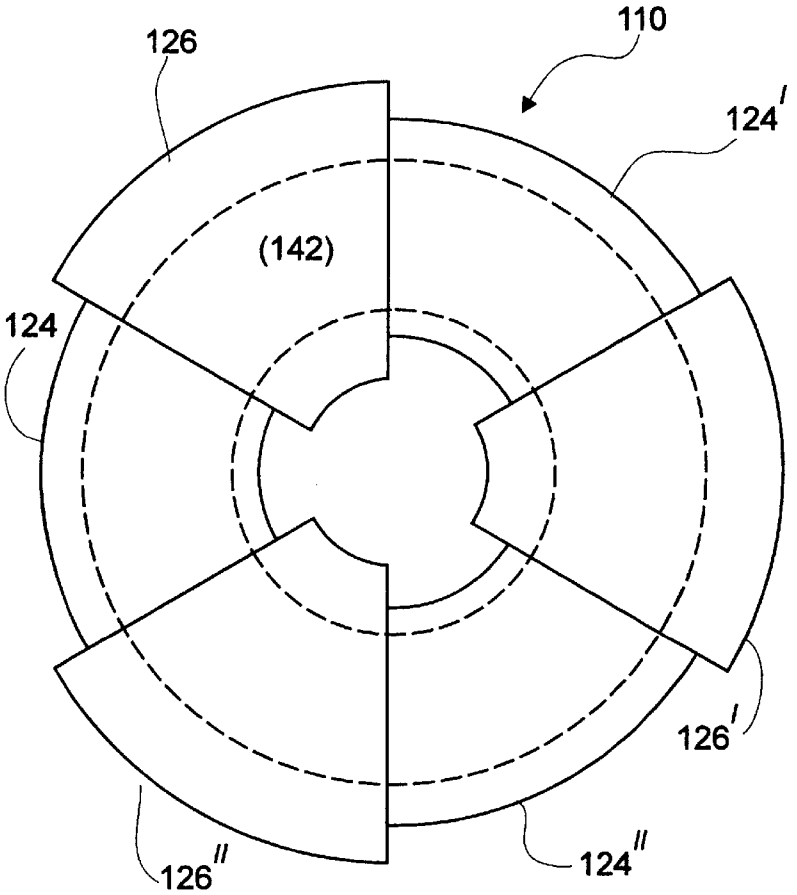
FIG. 5A is an end view of the device of FIG. 3, with the external solenoids in a fully open configuration.
Figure 5B:
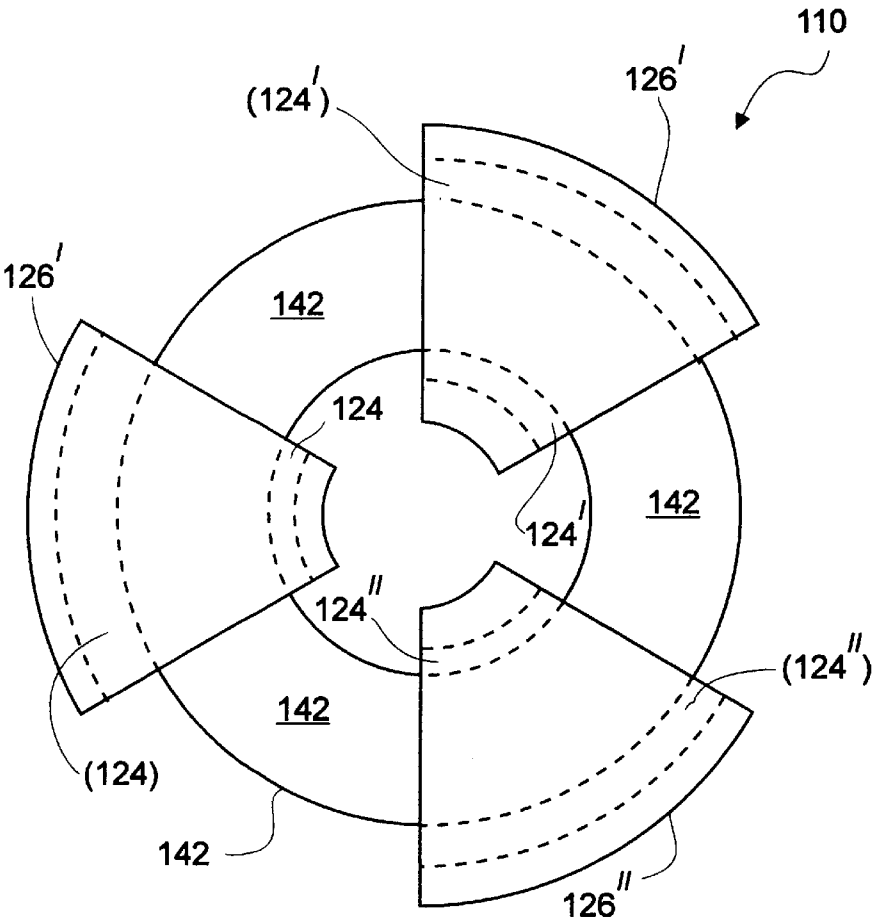
FIG. 5B is an end view of the device of FIG. 3, with the external solenoids in a fully closed configuration.

Device 110 also includes a mechanism (not shown) for sliding solenoids 126, 126' and 126" with respect to solenoids 124, 124' and 124". FIGS. 5A and 5B are end views of device 110 showing the external solenoids in a fully open configuration and in a fully closed configuration, respectively. Parts of device 110 that are hidden from view are represented in FIGS. 5A and 5B by dashed lines, and the associated reference numerals are enclosed in parentheses. In the fully open configuration of FIGS. 3, 4A, 4B, 4C and 5A, the magnetic field strength within envelope 142 is maximized. In the fully closed configuration of FIG. 5B, the magnetic field strength within envelope 142 is minimized. The operation of device 110 is analogous to the operation of device 10.

In both devices 10 and 110, each pair of secondary electrodes defines a transverse direction that is perpendicular both to the direction of current flow through the device in the absence of a magnetic field (the "current path") and to the magnetic field. In device 10, this transverse direction is perpendicular to the plane of FIG. 1. In device 110, this direction is the radial direction.

Figure 6:
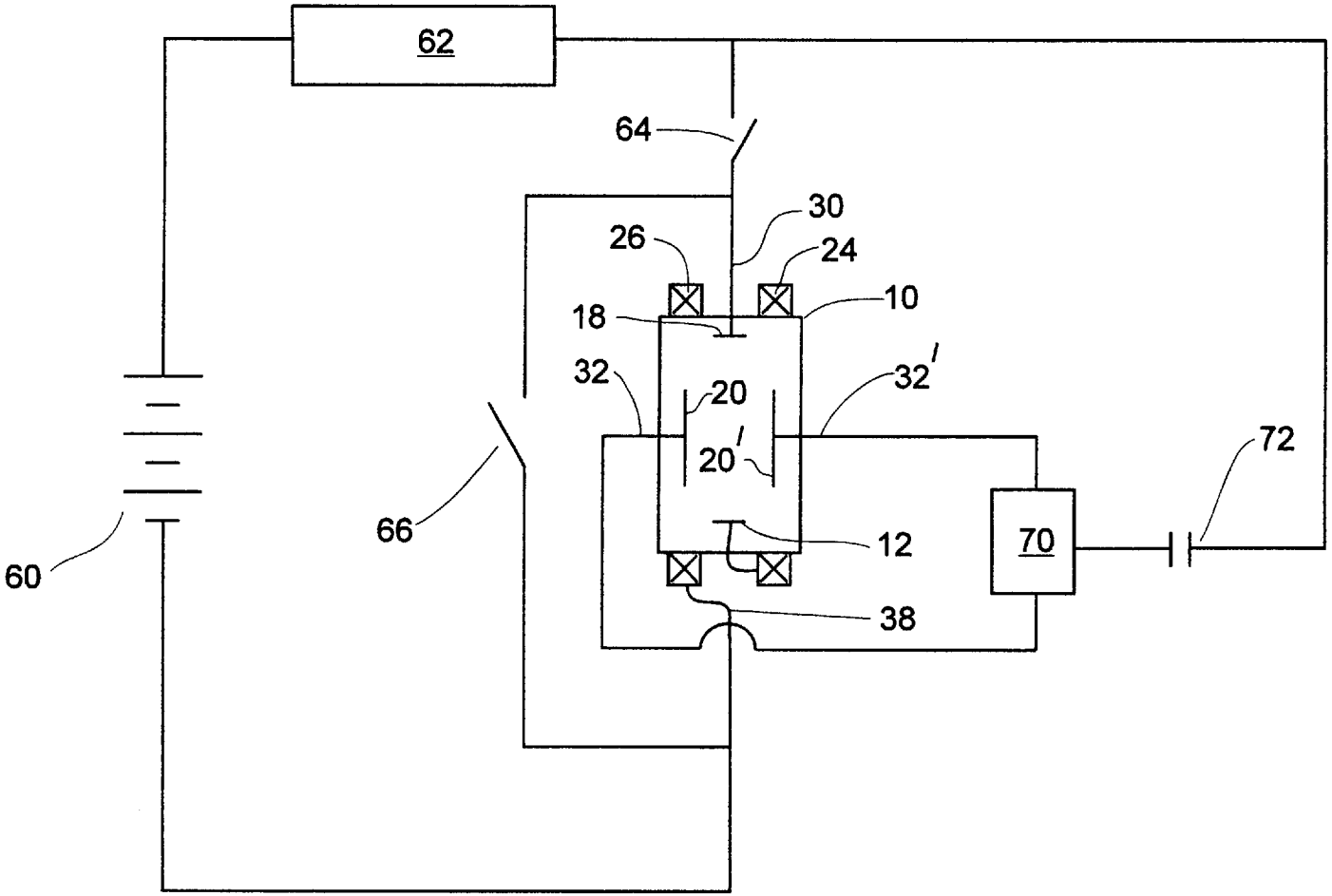
FIG. 6 is a circuit diagram illustrating the use of a device of the present invention to interrupt a high power direct current.

FIG. 6 is a circuit diagram that illustrates how device 10 is used to interrupt the flow of high power direct current. In FIG. 6, a high power DC source 60 drives a load 62 through a primary circuit that also includes two switches 64 and 66. Note that device 10 and switch 66 are in parallel, with device 10 being in series with the rest of the primary circuit via leads 30 and 38. While the primary circuit is operative, switches 64 and 66 are closed, and device 10 is inoperative, so all the current of the primary circuit flows through closed switch 66. Leads 32 and 32' are connected to a suitable secondary load 70, which is also connected to the primary circuit via a capacitor 72. Solenoids 24 and 26 are at maximum separation.

Note that, for simplicity, only electrode pair 20-20' and leads 32 and 32' are shown in FIG. 6. In practice, both leads 30 and 32 would be connected to one side of load 70, and both leads 32' and 34' would be connected to the other side of load 70. Alternatively, a variant of device 10 having only one pair of secondary electrodes could be used.

To interrupt the flow of current through the primary circuit, the ignition unit of device 10 is used to initiate the glow discharge. Solenoid 46 spreads the arc discharge uniformly over the surface of cathode 12 until thermionic emission of electrons from cathode 12 is initiated. With current now flowing through both switch 66 and device 10, switch 66 may be opened safely. Solenoids 24 and 26 now are brought together to maximize the transverse magnetic field within device 10, thereby diverting all of the current therethrough to load 70 via electrodes 20 and 20', and also charging up capacitor 72. Switch 64 now may be opened safely. Solenoids 24 and 26 now are restored to their original position, minimizing the transverse magnetic field and allowing the residual current through device 10 to decay.

It is clear that device 10 or device 110 can be used similarly to divert only a portion of the current of a primary circuit to one or more secondary loads, by positioning the external solenoids of the devices to divert only part of the primary current to one or more pairs of secondary electrodes. Furthermore, the devices of the present invention can be cascaded. For example, a second device 10 can be used as the secondary load of a first device 10. This allows the precise and rapid variation of the potential difference imposed on a secondary load of the second device 10.

While the invention has been described with respect to a limited number of embodiments, it will be appreciated that many variations, modifications and other applications of the invention may be made.

What is claimed is:

1. A gas discharge tube comprising:

(a) a rigid envelope;

(b) a cathode, deployed within said envelope;

(c) an anode, deployed within said envelope, said cathode and said anode defining between them a current path;

(d) at least one pair of secondary electrodes, deployed within said envelope so that said current path runs between a first electrode of said at least one pair and a second electrode of said at least one pair, said first electrode of said at least one pair and said second electrode of said at least one pair defining between them a transverse direction; and (e) a mechanism for creating a magnetic field substantially perpendicular to both said current path and said transverse direction, so that a plasma, within said envelope, wherethrough an electrical current travels from said anode to said cathode, is caused to separate into a positive region adjacent to said first electrode of said at least one pair and a negative region adjacent to said second electrode of said at least one pair.

2. The gas discharge tube of claim 1, further comprising:

(f) an inert gas substantially filling said envelope.

3. The gas discharge tube of claim 2, wherein said inert gas is selected from the group consisting of hydrogen, nitrogen and noble gases.

4. The gas discharge tube of claim 1, wherein said mechanism for creating said magnetic field includes a first solenoid and a second solenoid.

5. The gas discharge tube of claim 4, wherein at least one of said first solenoid and said second solenoid is slidably mounted outside said envelope.

6. The gas discharge tube of claim 4, further comprising:

(f) a mechanism for sliding said at least one of said first solenoid and said second solenoid relative to said envelope.

7. The gas discharge tube of claim 4, wherein each of said first solenoid and said second solenoid is in series with said cathode.

8. The gas discharge tube of claim 1, further comprising:

(f) a mechanism for cooling said cathode, said anode and said envelope.

9. The gas discharge tube of claim 8, wherein said cooling mechanism includes:

(i) a plurality of channels in said cathode, said anode and said envelope; and (ii) a dielectric fluid circulating within said channels.

10. A method for regulating direct electrical current, comprising the steps of:

(a) providing a gas discharge tube including:

(i) a cathode;

(ii) an anode, and ( iii) at least two secondary electrodes mounted so that the current from said anode to said cathode flows between said secondary electrodes, said two secondary electrodes defining between them a transverse direction;

(b) causing the current to flow through a plasma in said gas discharge tube from said anode to said cathode; and (c) separating charge in said plasma so that a region of positive charge is formed adjacent to one of said secondary electrodes and a region of negative charge is formed adjacent to another of said secondary electrodes, wherein said charge separation is effected by a magnetic field substantially perpendicular to both the current and said transverse direction.

11. The method of claim 10, further comprising the step of:

(d) attaching said secondary electrodes to a load, said separated charges thereby establishing a voltage difference across said load.

* * * * *